US005180245A

United States Patent [19]

Iizuka

[11] Patent Number: 5,180,245

[45] Date of Patent: Jan. 19, 1993

[54] LIQUID CONTAINER WITH SPECIFIC VALVE

[75] Inventor: Shigeo Iizuka, Funabashi, Japan

[73] Assignee: Yoshino Kogyosho Co., Ltd., Tokyo, Japan

[21] Appl. No.: 794,666

[22] Filed: Nov. 18, 1991

Related U.S. Application Data

[60] Continuation of Ser. No. 651,010, Feb. 5, 1991, abandoned, which is a division of Ser. No. 400,884, Aug. 30, 1989, Pat. No. 5,007,757.

[30] Foreign Application Priority Data

Jun. 2, 1988 [JP] Japan ..... 63-115833
Sep. 8, 1988 [JP] Japan ..... 63-118257

[51] Int. Cl.[5] ..... A46B 11/02

[52] U.S. Cl. ..... 401/278; 401/206; 401/279

[58] Field of Search ..... 401/278, 279, 273, 206, 401/260, 264

[56] References Cited

U.S. PATENT DOCUMENTS

| | | | |
|---|---|---|---|
| 519,223 | 5/1894 | Bailey . | |
| 1,138,772 | 5/1915 | Matthews . | |
| 1,207,121 | 12/1916 | Zeidler . | |
| 1,348,681 | 8/1920 | Wright . | |
| 1,438,510 | 12/1922 | Wasserlein | 401/260 |
| 1,557,357 | 10/1925 | Gornell . | |
| 2,293,211 | 8/1942 | Mureau . | |
| 2,623,231 | 12/1952 | Gutenstein . | |
| 2,714,475 | 8/1955 | Roehrich | 401/264 X |
| 3,140,695 | 7/1964 | Fehling et al. . | |
| 3,167,806 | 2/1965 | Hogan . | |
| 3,181,539 | 5/1965 | Aston . | |
| 3,340,561 | 9/1967 | Schwartzman | 401/260 X |
| 3,351,074 | 11/1967 | Aston . | |
| 3,359,992 | 12/1967 | Cishek et al. . | |
| 3,468,612 | 9/1969 | Aston . | |
| 3,545,874 | 12/1970 | Schwartzman | 401/264 X |
| 4,033,700 | 7/1977 | Spatz . | |
| 4,309,119 | 1/1982 | Wittersheim . | |
| 4,405,249 | 9/1983 | Scales . | |
| 4,433,799 | 2/1984 | Corsette . | |
| 4,541,552 | 9/1985 | Scheithauer | 401/264 X |
| 4,624,594 | 11/1986 | Sasaki et al. . | |
| 4,655,690 | 4/1987 | Boedecker et al. . | |
| 4,776,717 | 10/1988 | Iizuka et al. . | |
| 4,808,022 | 2/1989 | Iizuka et al. . | |
| 4,852,772 | 8/1989 | Ennis, III . | |

FOREIGN PATENT DOCUMENTS

| | | | |
|---|---|---|---|
| 165657 | 1/1954 | Australia . | |
| 62059/65 | 2/1967 | Australia . | |
| 0123518 | 10/1984 | European Pat. Off. . | |
| 199597 | 10/1986 | European Pat. Off. | 401/206 |
| 2630569 | 1/1978 | Fed. Rep. of Germany . | |
| 2551636 | 9/1949 | France . | |
| 959036 | 3/1950 | France . | |
| 552673 | 12/1956 | Italy . | |
| 61-180612 | 11/1986 | Japan . | |
| 62-86111 | 6/1987 | Japan . | |
| 62-90017 | 11/1987 | Japan . | |
| 63-52511 | 4/1988 | Japan . | |
| 136990 | 8/1952 | Sweden . | |
| 14133 | of 1899 | United Kingdom | 401/260 |
| 688891 | 3/1953 | United Kingdom . | |
| 1562817 | 3/1980 | United Kingdom . | |
| 2150424 | 7/1985 | United Kingdom . | |

*Primary Examiner*—Steven A. Bratlie
*Attorney, Agent, or Firm*—Oliff & Berridge

[57] ABSTRACT

A liquid container comprising: a shaft; a fixed cylinder including a discharge valve and provided on an upper end of the shaft; a liquid supply mechanism provided on an upper end of the fixed cylinder; a liquid receiving mechanism provided in the shaft and slidable with respect to the shaft; a movable cylinder including a suction valve, the movable cylinder being fitted in an upper end of the liquid receiving mechanism and slidable with respect to the fixed cylinder; springs for rearwardly biasing the movable cylinder; and a push button provided at a lower end of the shaft.

6 Claims, 8 Drawing Sheets

LIQUID CONTAINER WITH SPECIFIC VALVE

This is a continuation of application Ser. No. 07/651,010 filed Feb. 5, 1991, now abandoned, which in turn is a division of application Ser. No. 07/400,884 filed Aug. 30, 1989, now U.S. Pat. No. 5,007,757.

BACKGROUND OF THE INVENTION

1. Field of the Invention

The present invention relates to a liquid container, and more particularly, to a liquid container such as an eye brow pencil, a liquid lipstick or the like.

2. Prior Art

In the art of toilet implements, a liquid container with a toilet brush having the shape of a brush pen has been known in which a small quantity of liquid toilet material is supplied to the toilet brush at the upper end of a container each time when the rear end of the container is pushed in by a finger tip.

FIG. 16 shows a container of this kind. The container is composed of a fixed member 101 and a movable member 102 arranged in a shaft 108 and capable of being pushed into said fixed member 101. The fixed member 101 is composed of a fixed barrel 103 having an inner barrel 104 and an outer barrel 105, and a toilet brush 106 fitted into the upper end of the inner barrel 104. A resiliently closed discharge valve 107 is provided internally of the inner barrel 104. The inner barrel 104 forms an upper half of a cylinder. A shaft 108 is mounted by screw on the external portion of the fixed barrel 103. The movable member 102 is composed of a container body 109 and a movable cylinder 110. A push button 111 is provided on the lower end of the container body 109. The container body 109 is provided internally of the shaft 109 and is slidable in an axial direction of the container with respect to the shaft 108. The lower portion of a movable cylinder 110 is fitted in and secured to a neck of the container body 109. The movable cylinder 110 forms a lower half portion of the cylinder. A suction valve 112 is provided internally of the rear portion of the movable cylinder 110. The movable cylinder 110 is provided externally of the inner barrel 104 and is slidable with respect to the inner barrel 104 in an axial direction of the container. The movable cylinder 110 and the container body 109 are normally biased rearward by means of a return spring 113. Accordingly, the movable cylinder 110 of the movable member and the container body 109 may be pushed into the fixed member 101.

The movable member 102 is pushed into the fixed member 101 whereby a pressure chamber 114 of the cylinder is contracted. Accordingly, the toilet liquid within the pressure chamber 114 is pressed. The pressed toilet liquid pushes up the discharge valve 107 to open the discharge valve 107. The pressed toilet liquid is supplied to the toilet brush 106 through a discharge port 115. When the push button 111 is released after the toilet liquid in the pressure chamber 114 has been supplied to the toilet brush 106, the movable member 102 is pushed back by the return spring 113 and therefore the interior of the pressure chamber 114 becomes negative pressure. Accordingly, the suction valve 112 is opened so that the toilet liquid in the container body 109 is sucked into the pressure chamber 114.

The discharge valve 107 comprises a discharge valve member 116 made of resilient material, and a valve seat 117 provided internally of the inner barrel 104. The discharge valve member 116 comprises a discharge port forming barrel 118, a pair of resilient valve stems 119 and 119 and a valve body 120. The pair of resilient valve stems 119, 119 are suspended from the lower surface of a reduced diameter portion 121 formed in the lower part of the discharge port forming barrel 118, the resilient valve stems facing to each other in a diametrical direction of the inner barrel 104. The resilient valve stem 119 comprises an upper portion, an intermediate portion and a lower portion. Said intermediate portion is curved outwardly. When the toilet liquid within the pressure chamber 114 is pressed, the valve body 120 is forced upwardly, and the resilient valve stem 119 is spread outwardly and compressed up and down. Accordingly, the discharge valve 107 is opened.

Since in the aforementioned known container, the push button 111 is pushed in by hand, control of pushing-in is difficult. When the push button 111 is excessively pressed, the supply of the toilet material to the toilet brush 106 often becomes excessive. On the other hand, when the pushing-in of the push button 111 is short, the push button 111 often has to be pushed again.

Since the container of this type has a shape of a small diameter pen, there is naturally a restriction in the diameter of the inner barrel 104. The intermediate portion of the resilient valve stem 119 is curved externally. When the discharge valve 107 is opened, the curved portion is further spread and deformed outwardly. Thus, it is necessary to make the upper portion and the lower portion of the two resilient valve stems 119 and 119 close to each other. Accordingly, it is necessary that a reduced diameter portion 121 is provided at the lower portion of the barrel 118, and the valve stems 119 and 119 are suspended from the reduced diameter portion 121. Since the reduced diameter portion 121 is provided, the diameter of the discharge port 115 becomes small whereby the flow passage resistance to the toilet liquid in the discharge port 115 increases. According to the aforesaid construction, it has been difficult to smoothly supply the toilet liquid to the toilet brush 116.

SUMMARY OF THE INVENTION

An object of the present invention is to overcome the problems noted above with respect to known art. More specifically, an object of the present invention is to provide a liquid container which can switch the stroke of a knock button every push. A further object of the present invention is to provide a container in which the inside diameter of a discharge port is large, and accordingly, the flow passage resistance of liquid in the discharge port can be reduced to smoothly supply the liquid. Still another object of the present invention is to provide a container which can change the shape of a tip. Other objects will become apparent from the ensuing description.

According to the present invention, there is provided a liquid container comprising: a shaft; a fixed cylinder including a discharge valve and provided on an upper end of the shaft; a liquid supply means provided on an upper end of said fixed cylinder; a liquid receiving means provided in the shaft and slidable with respect to the shaft; a movable cylinder including a suction valve, the movable cylinder being fitted in an upper end of the liquid receiving means and slidable with respect to the fixed cylinder; springs for rearwardly biasing the movable cylinder; and a push button provided at a lower end of the shaft.

DESCRIPTION OF THE PREFERRED EMBODIMENTS

Figure 1:
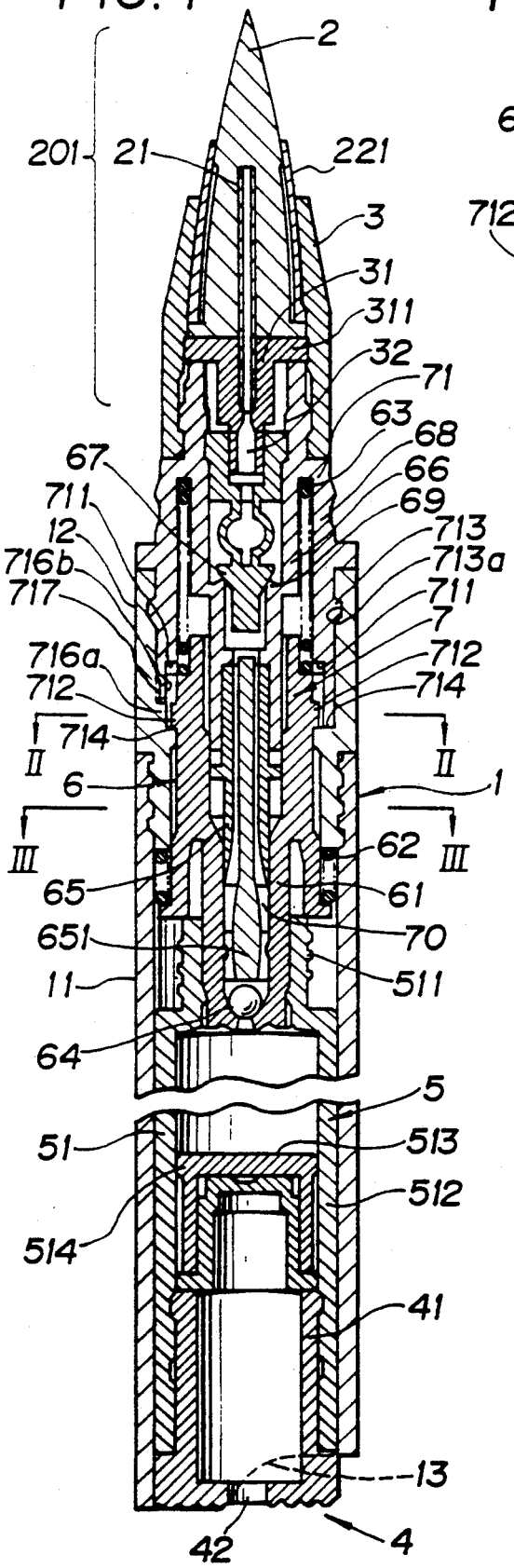
FIG. 1 is a longitudinal sectional view of a container according to a first embodiment of the present invention.
Figure 2:
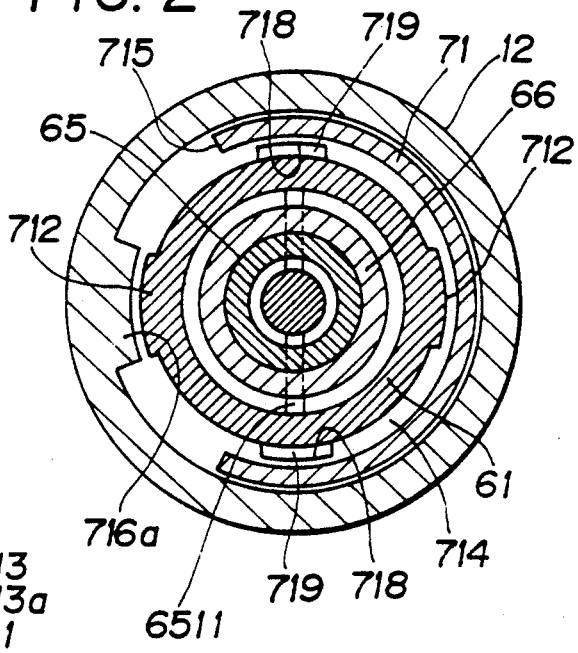
FIG. 2 is a sectional view taken on line II—II of FIG. 1.
Figure 3:
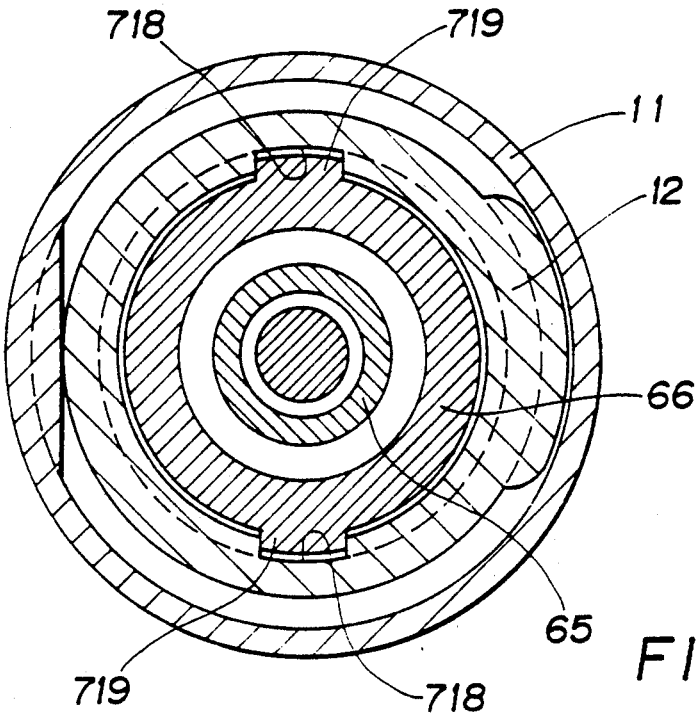
FIG. 3 is a sectional view taken on line III—III of FIG. 1.
Figure 7:
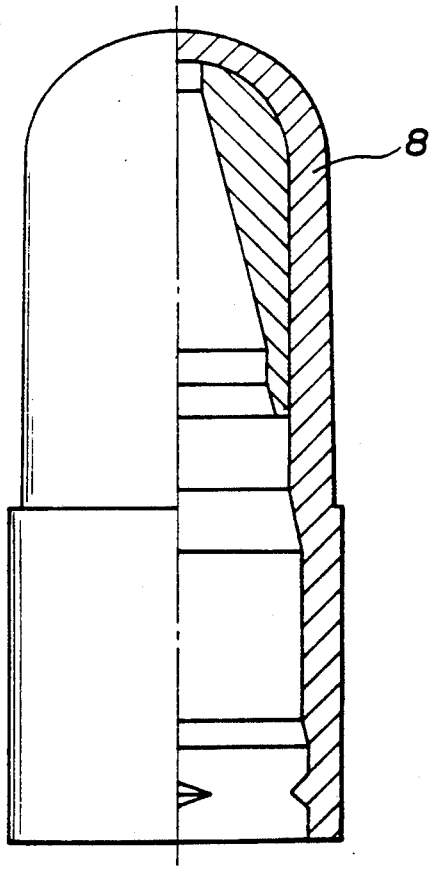
FIG. 7 is a partly cutaway side view of a cap.

FIGS. 1 to 7 show a first embodiment of the present invention.

A container according to the first embodiment includes means for switching one push stroke of a push button. In the drawings, reference numeral 1 denotes a shaft. Liquid supply means 201 is provided at an upper end of the shaft 1. In the illustrated embodiment, the liquid supply means 201 comprises a cylinder 3 and a tip 2 secured to the cylinder 3. Reference numeral 4 designates a push button. Reference numeral 5 designates a liquid receiving means. Reference numeral 6 designates a pump mechanism. Reference numeral 7 designates a stroke switching means provided between the shaft and the liquid supply means 201. Reference numeral 8 designates a cap capable of being detachably fitted externally of the liquid supply means 201.

In the first embodiment, the shaft 1 comprises a barrel 11 and a lip cylinder 12 fitted in an upper end of the barrel 11. A notch 13 is formed in a rear end of the shaft 1.

The tip 2 comprises, for example, brushes made of synthetic resin capable of being immersed with a liquid such as a liquid toilet material. A small diameter core 21 for guiding the liquid toilet material toward an upper portion of the tip is provided in the tip 2. The lower half portion of the tip 2 is surrounded by a keep member 221.

A communication cylinder 31 with a collar 311 is provided in the cylinder 3. A through-passage 32 is provided in a central portion of the communication cylinder 31. The core 21 is fitted in the through-passage 32. The keep member 221 is fixedly held internally of the cylinder 3.

The push button 4 is internally provided at the rear end of the shaft 1. The push button 4 can be forced into and removed from the shaft 1. The push button 4 has a fitting cylinder 41 engaged with the liquid receiving means 5. Accordingly, when the push button 4 is forced into the shaft 1, the liquid receiving means 5 is forced upwardly into the shaft 1. The push button 4 is detachably mounted on the liquid receiving means 5. A vent hole 42 is bored in a central portion of a rear end surface of the push button 4.

The liquid receiving means 5 comprises a container body 51 having a shape of an elongated bottle. The container body 51 is arranged externally of the rear end of the shaft 1. The container body 51 is slidable with respect to the shaft 1 in an axial direction of the container. The container body 51 can be removed from the shaft 1. A neck 511 of the container body 51 is engaged with an outer surface of a rear end of amovable cylinder 61 of the pump mechanism 6. Accordingly, the movable cylinder 61 moves as the container body 51 moves. The container body 51 may be detachably mounted on the movable cylinder 61. A movable bottom member 513 is slidably arranged in a body 512 of the container body 51. An elastic peripheral wall 514 is formed in an outer peripheral surface of an upper end of the movable bottom member 513. The wall 514 is pressed against an inner surface of the body 512. Accordingly, when a suction valve 64 is opened to pump up the liquid within the container body 51 so that an interior of the container body 51 becomes negative pressure, an atmospheric pressure acts on the lower portion of the movable bottom member 513 through the vent hole 42. Therefore, the movable bottom member 513 is urged by the atmospheric pressure and moves upwardly. A fitting cylinder 41 of the push button 4 is removably engaged with the lower end of the body 512.

The pump mechanism 6 includes a movable cylinder 61. The movable cylinder 61 is slidably arranged in the lip cylinder 12. A rear end of the movable cylinder 61 is engaged with the neck 511 of the container body 51. The cylinder 61 is normally urged rearwardly by coil springs 62 and 63 arranged within the shaft 1. A suction valve 64 is provided in the rear end internally of the movable cylinder 61. In the illustrated embodiment, the suction valve 64 comprises a ball valve. A skirt member 65 is fitted in an intermediate portion internally of the cylinder 61 and is slidable with respect to the cylinder 61. An adjusting rod 651 is provided on a core portion of the movable cylinder 61 and is coupled to the movable cylinder 61 by a connecting member 6511 radially projected.

The fixed cylinder 71 comprises an inner cylinder 66 and an outer cylinder 68 leaving a clearance between the latter and the outer surface of the inner cylinder 66 and continuous to an upper portion of the inner cylinder 66. The inner cylinder 66 comprises an upper half portion and a lower half portion. A diameter of the lower half portion of the inner cylinder 66 is smaller than the diameter of the upper half portion of the inner cylinder 66. A valve seat 69 of the discharge valve 67 is provided on an upward shoulder of the inner surface of a continuous portion between the upper half portion and the lower half portion. The skirt member 65 is mounted and secured to a lower end of the inner cylinder 66 of the fixed cylinder 71 of the stroke switching means 7. The movable cylinder 61 and the lower half portion of the inner cylinder 66 constitute a pressure chamber 70.

The stroke switching means 7 will be described hereinafter.

A projection 713 is provided on the outer peripheral surface at the rear end of the fixed cylinder 71. A groove 713*a* is provided in the inner peripheral surface at the upper end of the lip cylinder 12. The projection 713 is engaged with the groove 713*a*. The fixed cylinder 71 can be rotated with respect to the lip cylinder 12 but cannot be axially slidably moved with respect to the lip cylinder 12.

Figure 6:
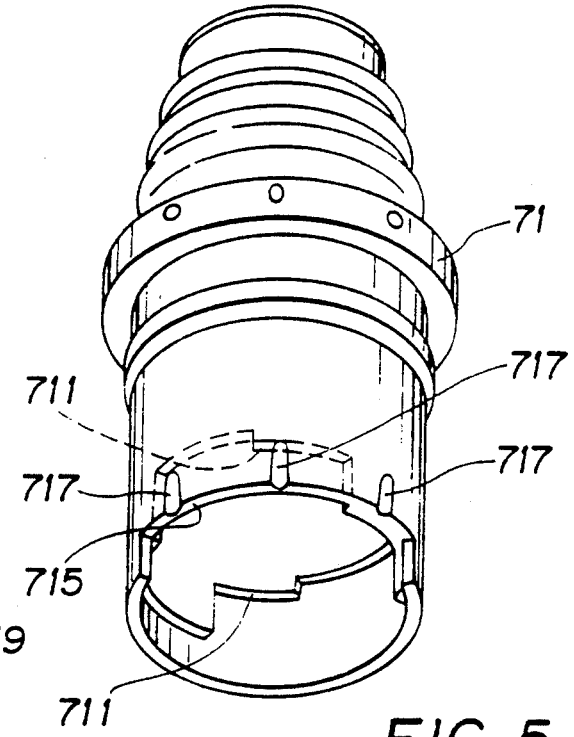
FIG. 6 is a perspective view of a fixed barrel according to a first embodiment of the present invention.
Figure 4:
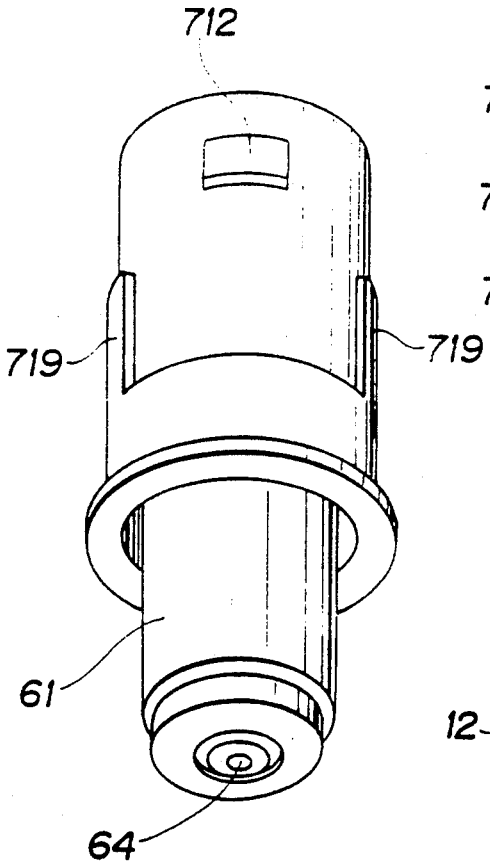
FIG. 4 is a perspective view of a movable cylinder according to a first embodiment of the present invention.
Figure 5:
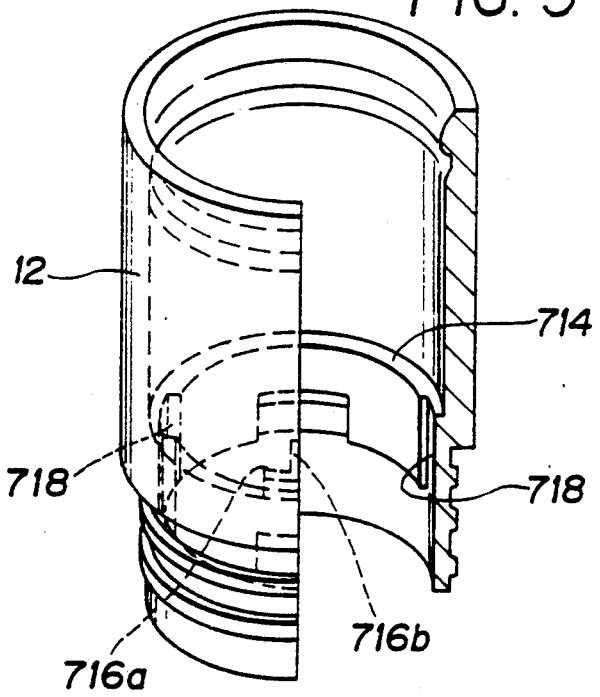
FIG. 5 is a partly cutaway perspective view of a lip cylinder according to a first embodiment of the present invention.

Rearwardly-directed abutting step portions 711 and 711 are provided in the inner surface at the rear end of the fixed cylinder 71. The step portion 711 comprises a plurality of steps whose axial-direction heights thereof are different from each other as shown in FIG. 6. In the illustrated embodiment, two step portions 711, 711 are provided symmetrically with respect to the axis of the fixed cylinder 71. Abutting portions 712, 712 are projected in the outer peripheral surface of the cylinder 61 corresponding to the abutting step portions 711, 711. In the illustrated embodiment, since two step portions 711, 711 are provided, two abutting portions 712, 712 are provided symmetrically with respect to the axis of the cylinder 61 corresponding to the step portions 711, 711. The rearwardly-directed surfaces (surfaces toward the push button) of the abutting step portions 711, 711 and the forwardly-directed surfaces (surfaces toward the cylinder) of the abutting portions 712, 712 are abutted with each other. The fixed cylinder 71 is rotated with respect to the cylinder 61 which axially moves along with the container body 51 so that the abutment step can be switched.

A forwardly-directed (toward the cylinder 3) step portion 714 is provided on the inner peripheral surface of the lip cylinder 12. Rearwardly-directed (toward the push button) surfaces of the abutting portions 712, 712 are normally brought into abutment with the step portion 714 by the bias of the coil springs 62 and 63.

A notch 715 is provided at the rear end of the fixed cylinder 71. A stopper 716*a* corresponding to the notch 715 is provided in the inner peripheral surface of the lip cylinder 12. The stopper 716*a* is abutted with the notch 715 so as to define a rotation of the fixed cylinder 71 with respect to the lip cylinder 12.

Recesses 717, 717 and 717 are provided in the outer peripheral surface at the rear end of the fixed cylinder 71 corresponding to the respective steps of the abutting step portions 711. A projection 716*b* to be inserted into each of the recesses 717 is provided in the inner peripheral surface of the lip cylinder 12. A position of the fixed cylinder 71 with respect to the lip cylinder 12 is selected by engagement of any one of the recesses 717 with the projection 716*b*.

Longitudinal grooves 718, 718 are provided at the rear of the inner peripheral surface of the lip cylinder 12. In the midst of the outer peripheral surface of the cylinder 61, longitudinal strips 719, 719 to be inserted into the longitudinal grooves 718, 718 are provided. By the engagement of the longitudinal strips 719, 719 with the longitudinal grooves 718, 718, the cylinder 61 can be axially slidably moved with respect to the lip cylinder 12 but cannot be rotated with respect to the lip cylinder 12.

The cylinder 3 is fitted in the upper end of the fixed cylinder 71.

The cap 8 can be detachably engaged with the fixed cylinder 71.

Operation of the liquid container according to the present invention will be described hereinafter.

A liquid toilet material is included in the container body 51 of the liquid receiving means 51. In supplying the liquid toilet material to the tip 2, the push button 4 is pressed against the coil springs 62 and 63 to actuate the pump mechanism 6 so that the liquid toilet material within the container body 51 is supplied to the tip 2.

Since the container body 51 is fitted in the movable cylinder 61, when the push button 4 is pressed, the movable cylinder 61 is pressed upwardly. Since the skirt member 65 is slidably fitted in the cylinder 61 and mounted and secured to the inner cylinder 66 of the fixed cylinder 71, even if the push button 4 is pushed in, the skirt member 65 is not pressed upwardly. Accordingly, a liquid pressure within the pressure chamber 70 increases. The suction valve 64 closes, and the discharge valve 67 opens. The liquid toilet material within the pressure chamber 70 is supplied to the tip 2 through the pipe 21

When the pressed push button 4 is released, the movable cylinder 61, the container body 51 and the push button 4 remain pressed down due to the resiliency of the coil springs 62 and 63. The pressure chamber 70 has a negative pressure so that the suction valve 64 opens and the discharge valve 67 closes. The liquid toilet material within the container body 51 is taken into the pressure chamber 70. The container body 51, therefore, has a negative pressure. Atmospheric pressure exerts against the interior of the push button 4 and the lower portion of the movable bottom member 513 through the vent hole 42 so that the movable bottom member 513 is moved upwardly.

One push stroke of the push button 4 can be switched by the stroke switching means 7. Since the neck 511 of the container body 51 is fitted and secured to the outer portion of the lower end of the movable cylinder 61, the stroke of the push button 4 is equal to the stroke of the movable cylinder 61. The axial movement of the abutting portions 712, 712 is defined between the forwardly-directed step portion 714 and the abutting step portions 711, 711 whereby the stroke of the cylinder 61 is obtained. Accordingly, the fixed cylinder 71 is rotated to change the step of the abutting step portion 711 in abutment with the abutting portions 712, 712 so that the stroke of the push button 4 can be switched. Thereby the supply of liquid to tip 2 can be adjusted.

An abutting step portion 711 may be formed on the movable cylinder 61, and an abutting portion 712 may be formed on the fixed cylinder 71. In this case, one step portion 711 is formed on the movable cylinder 61, and two or more abutting portions 712 are formed on the fixed cylinder 71.

Figure 8:
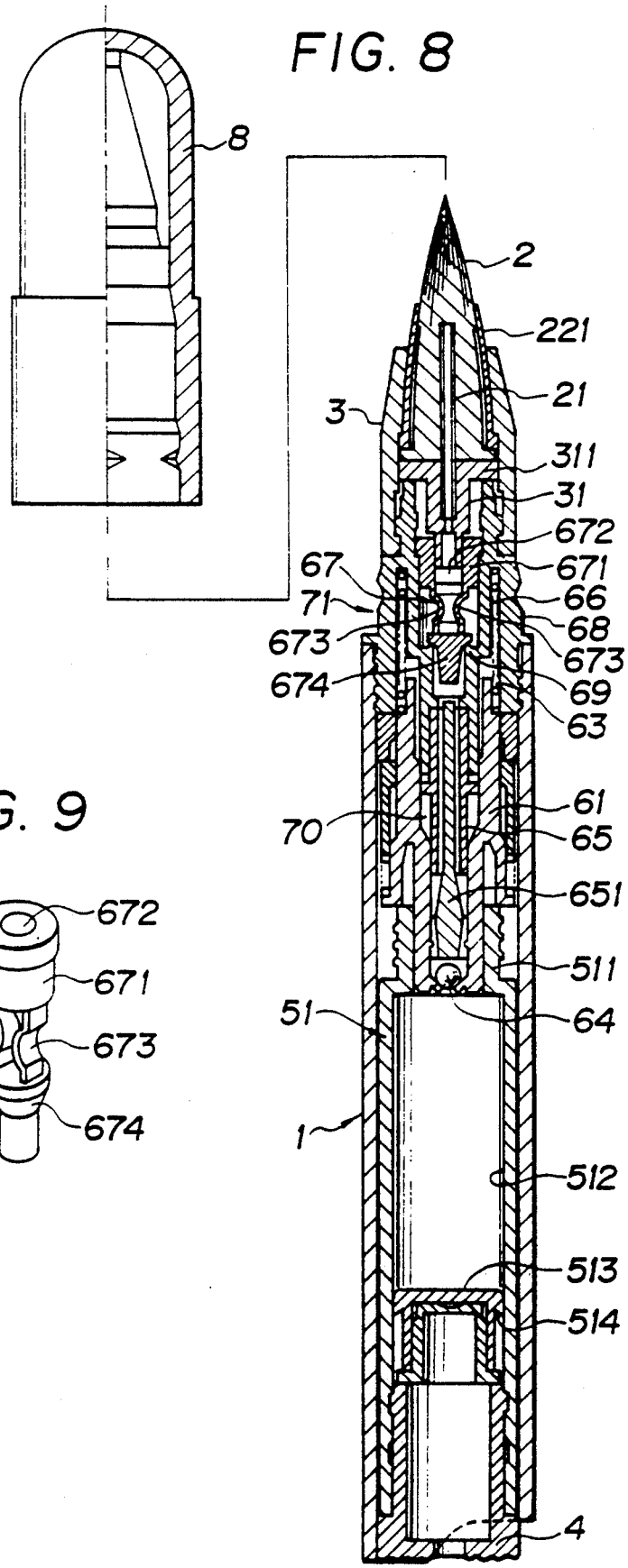
FIG. 8 is a longitudinal sectional view of a container according to a second embodiment of the present invention.
Figure 9:
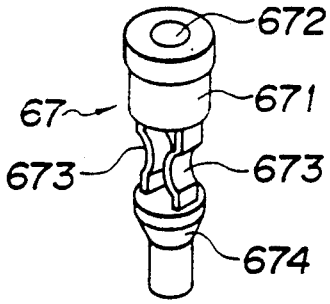
FIG. 9 is a perspective view showing a contour of a discharge valve according to a second embodiment of the present invention.
Figure 11:
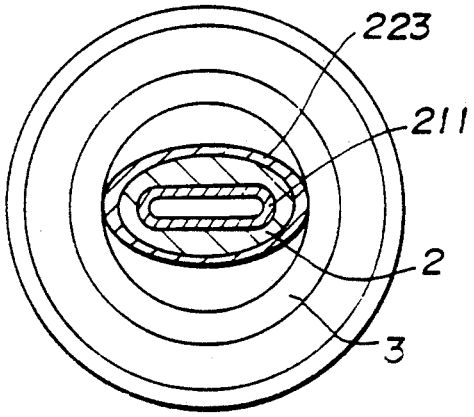
FIG. 11 is a sectional view taken on line IV—IV of FIG. 10.

FIGS. 8 and 9 show a second embodiment of the present invention.

In the second embodiment, intermediate portions of a pair of resilient valve stems 673, 673 of the discharge valve 67 are curved inwardly toward each other. Accordingly, the valve stems 673, 673 can be suspended from a portion in the vicinity of an outer peripheral edge of a lower surface of a discharge port forming cylindrical member 671 without use of a reduced diameter member. Accordingly, the size of the discharge port 672 can be increased to reduce passage resistance of the toilet liquid.

In the second embodiment, the shaft 1 comprises a single member. A threaded groove is formed in an inner surface at an upper portion of the shaft 1. Threads are formed in an outer surface of the outer cylinder. The threads of the outer cylinder 68 are screwed with the threaded groove of the shaft 1 so that the fixed cylinder 71 is internally fitted and secured to the upper end of the shaft 1.

A pair of resilient valve stems 673, 673 are suspended from a portion in the vicinity of an outer peripheral edge of a discharge port forming cylindrical member 671 at a position symmetrical with respect to the axis of the lower surface of the discharge port forming cylindrical member 671. The resilient valve stem pair 673, 673 comprise an upper portion, an intermediate portion and a lower portion. The intermediate portions of the resilient valve stems 673, 673 are curved inwardly toward each other. A valve body 674 is suspended from the resilient valve stems 673, 673. The cylindrical member 671 is internally fitted and secured to the upper portion of the inner cylinder 66. The upper portion of the cylindrical member 671 is engaged with a small diameter portion of a lower portion of the communication cylinder 31. The valve body 674 is in normally close contact with the upper surface of the valve seat 69 to close the discharge valve 67.

When the liquid within the pressure chamber 70 is pressed, the resilient valve stems 673, 673 are further curved and deformed inwardly so that the valve body 674 is forced upwardly to open the discharge valve 67. The pressed liquid is supplied to the tip 2 passing through the discharge port 672, the communication cylinder 31 and the core 21.

The third embodiment of the present invention will be described with reference to FIGS. 10 to 15.

Figure 16:
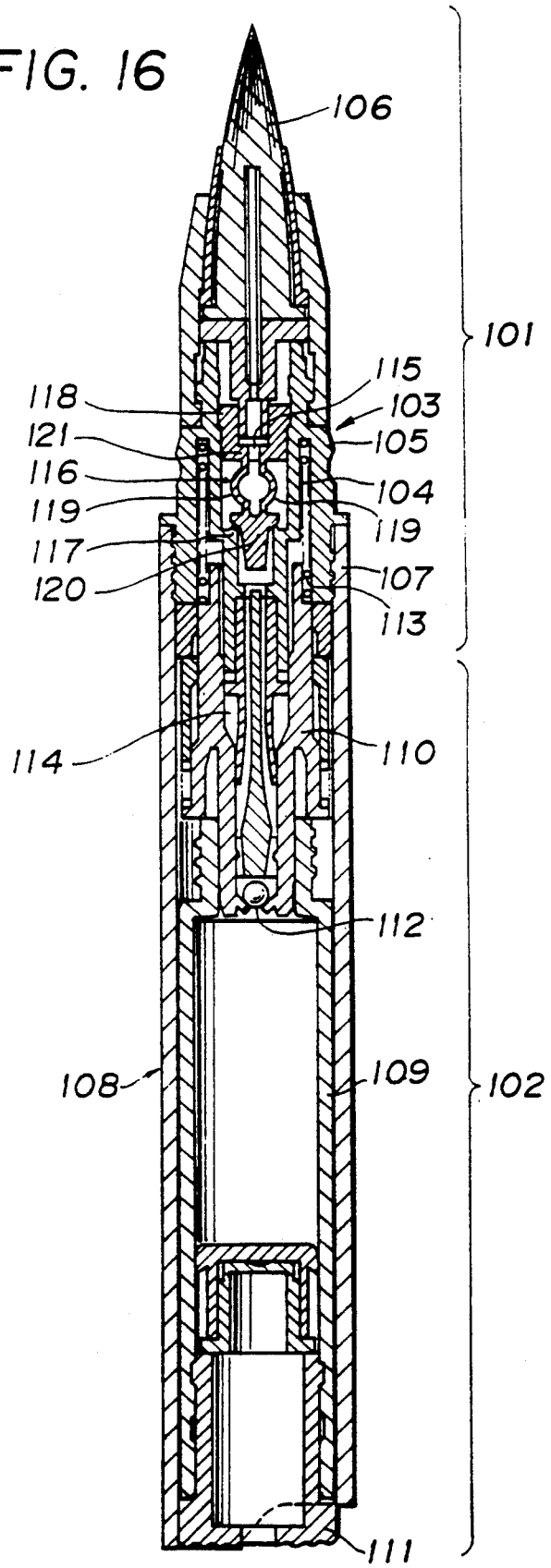
FIG. 16 is a longitudinal sectional view of a liquid container with a toilet tip of prior art.

A known liquid container with a toilet tip is provided with a conical toilet tip 106 as shown in FIG. 16. The container having the conical toilet tip 106 is suitable for use in drawing a line and effecting a fine finish. However, in the case where said container is used to coat the toilet material on a wide area portion, it has not been easy to coat the toilet material quickly and without unevenness. The object of the third embodiment according to the present invention is to provide a toilet tip suitable for coating the toilet material on a wide area portion in addition to effecting a fine finish.

The third embodiment relates to the construction of a liquid discharge portion of a liquid container. Any constructions of the liquid supply means (for example, a pump mechanism) can be applied to the third embodiment of this invention.

In the container of this embodiment, a communication cylinder 20 is secured to the inner surface of an upper end of a shaft 1. In the illustrated embodiment, a fixed cylinder 71 is arranged between the shaft 1 and the communication cylinder 20 but the structure is not limited thereto. A hole for supplying the liquid toilet material from the shaft 1 to the toilet tip 2 is formed in the axis of the communication cylinder 20. The lower portion of a core 21 is fitted without rotation into the hole. A flat tube 211 is formed at an upper portion of the core 21. A sectional face of the flat tube 211 has a long diameter and a short diameter. The long diameter of the flat tube 211 is larger than the short diameter of a flat cylinder 223 of a tip keeper 221 which will be described later. When the pump mechanism 6 operates, the toilet liquid within a liquid toilet material receiving means 5 is supplied to the tip 2 through the core 21.

Liquid supply means 201 is fitted in the upper end of the shaft 1. In the illustrated embodiment, the liquid supply means 201 is fitted into the fixed cylinder 71. The liquid supply means 201 comprises a cylinder 3, a tip keeper 221 and a toilet tip 2. The cylinder 3 has a peripheral wall 224. A lower portion of the cylinder 3 is rotatably engaged with an upper portion of the fixed cylinder 71. A flat cylindrical portion 223 of a cylindrical wall 222 of the tip keeper 221 is projected upwardly from an upper end surface of a peripheral wall 224 of the cylinder 3. A lower portion of the cylindrical wall 222 of the tip keeper 221 is fitted without rotation in the inner surface of the cylinder 3. A flat cylinder 223 is formed on an upper portion of the cylindrical wall 222 and is projected upwardly from the upper end surface of the cylinder 3. A sectional face of the flat cylinder 223 has a long diameter and a short diameter. The short diameter of the flat cylinder 223 is smaller than the short diameter of the flat tube 211 of the core 21. In a lower half portion of the toilet tip 2, the flat tube 211 of the core 21 is embraced through rotation at an axis of the toilet tip 2. An outer surface of the lower half portion of the toilet tip 2 is gripped without rotation by the tip keeper 221. Accordingly, the liquid supply means 201 is rotatable with respect to the shaft 1. More specifically, the cylinder 3 and the tip keeper 221 are rotatable with respect to the shaft 1. The communication cylinder 20, the core 21 and the toilet tip 2 are not rotatable with respect to the shaft 1.

The tip 2 comprises, for example, brushes made of synthetic resin and is formed in the shape of pyramid. According to the third embodiment, this pyramid can be changed to a substantially flat plate.

Figure 10:
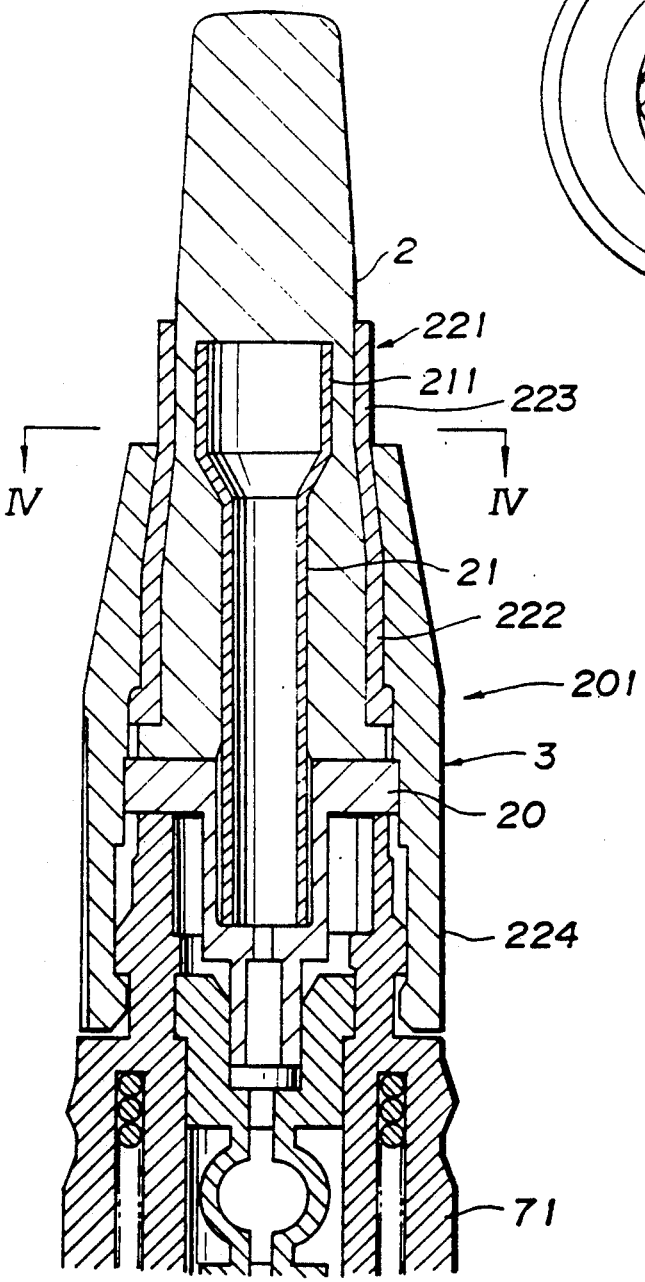
FIG. 10 is a longitudinal sectional view of liquid supply means in the case where a toilet implement has a flat-plate shape according to a third embodiment of the present invention.
Figure 12:
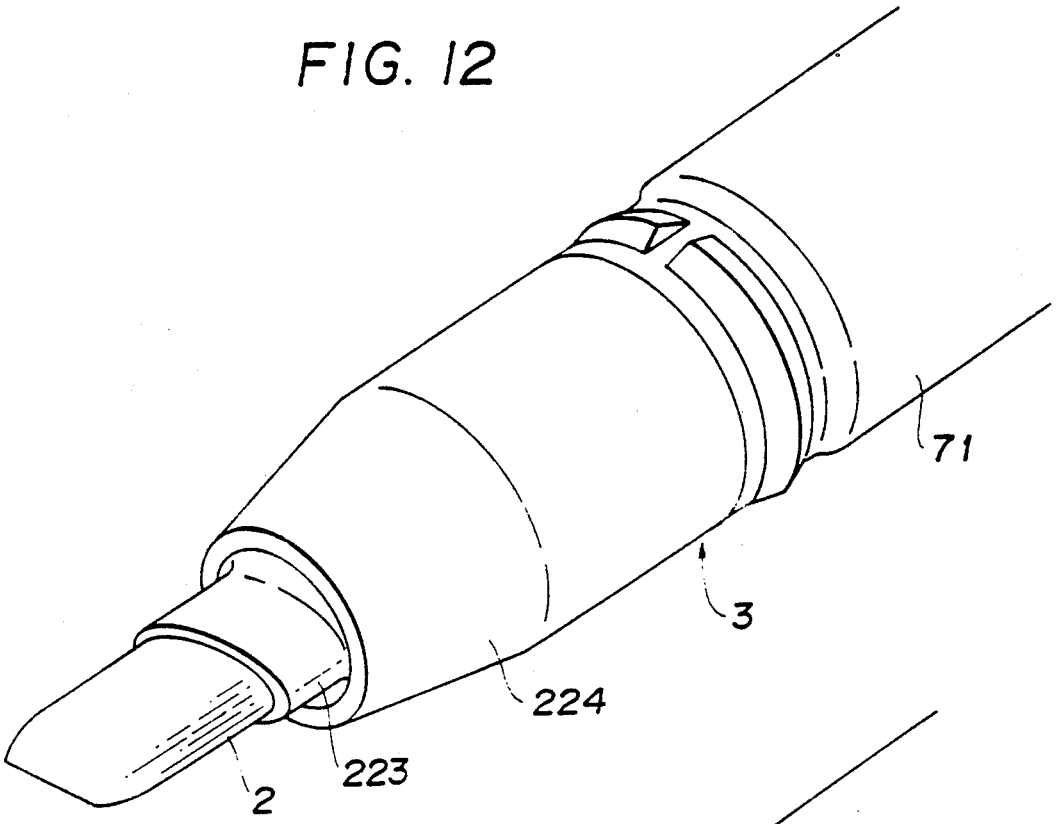
FIG. 12 is a perspective view of liquid supply means in the case where a toilet implement has a flatplate shape according to a third embodiment of the present invention.
Figure 15:
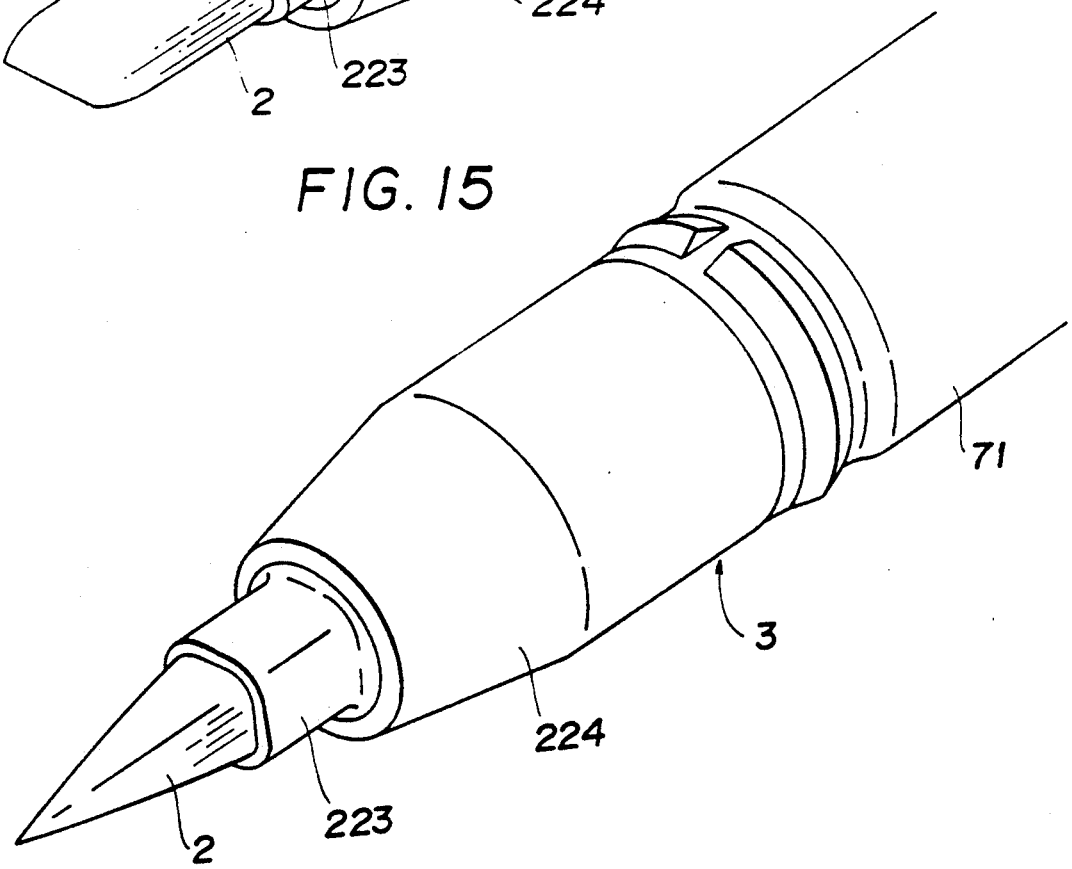
FIG. 15 is a perspective view of liquid supply means in the case where a toilet implement has a pyramid shape according to a third embodiment.
Figure 13:
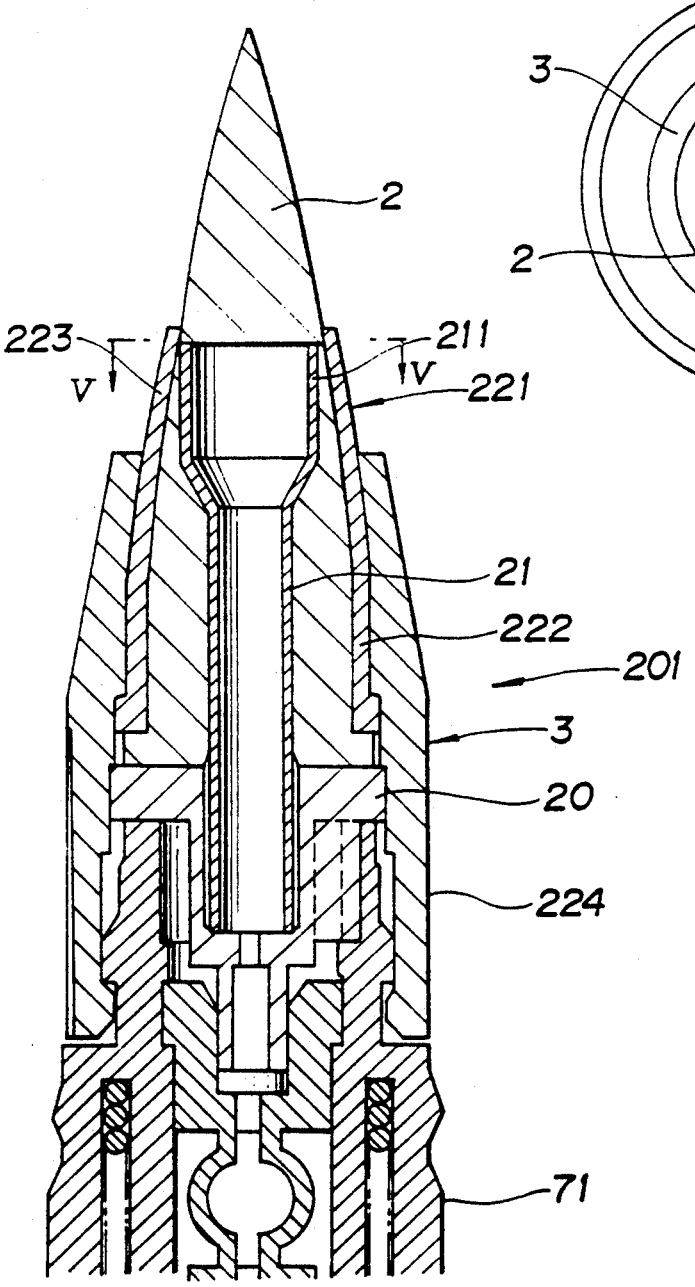
FIG. 13 is a longitudinal sectional view of liquid supply means in the case where a toilet implement has a pyramid shape according to a third embodiment.
Figure 14:
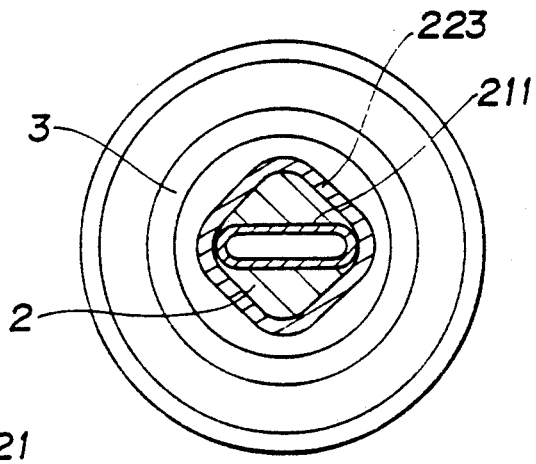
FIG. 14 is a sectional view taken on line V—V of FIG. 13.

FIG. 10 shows the case where the long diameter of the flat cylinder 223 of the cylindrical wall 222 and the long diameter of the flat tube 211 of the core 21 are in the same phase. In this case, the flat cylinder 223 and the flat tube 211 are not in contact with each other. When the liquid supply means 201 is rotated through 90° with respect to the shaft 1 from the state shown in FIG. 10, only the cylinder 3 and the tip keeper 221 are rotated with respect to the shaft 1. As previously mentioned, the short diameter of the flat cylinder 223 is smaller than the long diameter of the flat tube 211 of the core 21. Accordingly, as shown in FIG. 14, the flat cylinder 223 is pressed against both ends in the direction of the long diameter of the flat tube 211 so that the flat cylinder 223 is spread by the flat tube 211. Accordingly, the shape of the toilet tip 2 is changed from a flat plate shown in FIG. 12 to a pyramid shape as shown in FIG. 15. When the liquid supply means 201 is again rotated through 90° from that state with respect to the shaft 1, both ends in the direction of the long diameter of the flat tube 211 are moved away from the flat cylinder 223. Accordingly, the flat cylinder 223 is elastically returned so that the toilet tip 2 is formed from a pyramid shape to a flat plate shape.

I claim:

1. A liquid container comprising:

a shaft;

a fixed cylinder provided on an upper end of the shaft;

a liquid supply means provided on an upper end of said fixed cylinder;

a liquid receiving means provided in the shaft and slidably with respect to the shaft;

a movable cylinder including a suction valve, said movable cylinder being fitted in an upper end of the liquid receiving means and being slidable with respect to said fixed cylinder, said liquid supply means, said fixed cylinder, said movable cylinder and said liquid receiving means defining a passage for the liquid;

springs for biasing the movable cylinder with respect to the fixed cylinder;

a push button provided at a lower end of the shaft for sliding said liquid receiving means; and a discharge valve located within said fixed cylinder and coupled for selective fluid communication between said liquid supply means and said liquid receiving means, said discharge valve comprising a discharge port forming cylindrical member having a discharge port therein fitted and secured in said fixed cylinder, a valve body movably seated in a valve seat in said passage for selectively opening and closing said passage, and resilient spaced valve stems formed between said discharge port forming cylindrical member and said valve body, intermediate portions of the resilient valve stems being curved inwardly toward each other.

2. The liquid container of claim 1, wherein said discharge port has a diameter substantially equivalent to a diameter of said valve seat.

3. The liquid container of claim 1, wherein said valve stems are located closely adjacent to said fixed cylinder.

4. The liquid container of claim 1, wherein discharge port has a generally constant interior diameter and said valve stems extend axially from said cylindrical member substantially colinearly with said interior diameter.

5. The liquid container of claim 1, wherein said push button is slidingly movable within said shaft and has a stroke length being selectively adjustable by rotation of said fixed cylinder with respect to said movable cylinder.

6. The liquid container of claim 1, wherein said fixed cylinder is rotatable with respect to said shaft, said fixed cylinder having a rearwardly-directed abutting step portion formed thereon, and said movable cylinder having an abutting portion formed thereon, said abutting step portion of said fixed cylinder abutting said abutting portion of said movable cylinder.

* * * * *